US007753964B2

(12) United States Patent
Hueffer et al.

(10) Patent No.: US 7,753,964 B2
(45) Date of Patent: Jul. 13, 2010

(54) METHOD FOR PRODUCING A LEATHER SEMI-FINISHED PRODUCT

(75) Inventors: Stephan Hueffer, Ludwigshafen (DE); Stefan Schroeder, Neuleiningen (DE); Juergen Carle, Ludwigshafen (DE); Thorsten Raedler, Ludwigshafen (DE); Volker Bach, Neustadt (DE); Tilman Luedecke Taeger, Seeheim-Jugenheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 1493 days.

(21) Appl. No.: 10/531,178

(22) PCT Filed: Nov. 25, 2003

(86) PCT No.: PCT/EP03/13204

§ 371 (c)(1),
(2), (4) Date: Apr. 11, 2005

(87) PCT Pub. No.: WO2004/048616

PCT Pub. Date: Jun. 10, 2004

(65) Prior Publication Data

US 2006/0075573 A1 Apr. 13, 2006

(30) Foreign Application Priority Data

Nov. 26, 2002 (DE) ..... 102 55 095

(51) Int. Cl.
*C14C 1/00* (2006.01)
*C14C 3/08* (2006.01)

(52) U.S. Cl. ..... 8/94.15; 8/94.1 R; 8/94.18; 8/94.19 R; 8/94.33; 8/94.1 D

(58) Field of Classification Search ..... 8/94.19 R, 8/94.15, 94.18, 94.33, 94.1 D
See application file for complete search history.

(56) References Cited

U.S. PATENT DOCUMENTS

| | | | | |
|---|---|---|---|---|
| 4,039,281 | A * | 8/1977 | Graf | 8/94.14 |
| 4,272,242 | A * | 6/1981 | Plapper et al. | 8/94.18 |
| 4,442,687 | A * | 4/1984 | Muntjes | 69/1 |
| 6,033,590 | A * | 3/2000 | Komforth et al. | 252/8.57 |
| 7,378,479 | B2 * | 5/2008 | Tamareselvy et al. | 526/333 |
| 2002/0192366 | A1 * | 12/2002 | Cramer et al. | 427/180 |

FOREIGN PATENT DOCUMENTS

| | | |
|---|---|---|
| DE | 27 32 217 | 2/1979 |
| DE | 102 37 259 | 2/2004 |
| EP | 0 281 486 | 9/1988 |
| GB | 568 180 | 3/1945 |

OTHER PUBLICATIONS

Lakshminarayana, Y. et al. "A Novel Water Dispersable Bentonite - Acrylic Graft Copolymer as Filler Cum Retanning Agent", JALCA, vol. 97, No. 1, pp. 14-21, XP009020542 2002.
Roempp Chemie Lexikon, 9th edition, pp. 4651, 4652 1995.

* cited by examiner

*Primary Examiner*—Lorna M Douyon
*Assistant Examiner*—Amina Khan
(74) *Attorney, Agent, or Firm*—Oblon, Spivak, McClelland, Maier & Neustadt, L.L.P.

(57) ABSTRACT

A semifinished leather product is produced from an animal hide by pretanning with the use of a chromium-free tanning agent and of a clay mineral which, after stirring for 30 minutes in water at 50° C. at a circumferential rotor speed of from 5 to 25 m/s, has a number average particle diameter of less than 2 μm or a bimodal particle size distribution with a first, finely divided fraction whose number average particle diameter is less than 0.5 μm and a second, coarser fraction whose number average particle diameter is less than 5 μm, determined in each case by the method according to ISO 13320-1, by combined laser light diffraction and light scattering, a proportion of the first, finely divided fraction being from 10 to 90% by weight, and drying of the pretanned animal hide to a water content of from 5 to 45%, based on the total weight of the semifinished leather product.

20 Claims, No Drawings

METHOD FOR PRODUCING A LEATHER SEMI-FINISHED PRODUCT

The present invention relates to a process for the production of a semifinished leather product.

In the leather industry, the readily perishable raw material, the animal hide, must be converted into a biologically and mechanically stabilized state in order to be storable and transportable. For this purpose, semifinished leather products are produced by pretanning, as a rule by the following two, basically different processes:

On the one hand, by pretanning with corrosion-containing tanning agents to give the wet blue semifinished product and, on the other hand, by chromium-free pretanning to give the wet white semifinished product.

Biocides can be added to semifinished leather products in the moist state and then, if a maximum temperature of 25° C. is not exceeded during transport and storage, said semifinished products can be stored for up to about 1 year.

Wet blue semifinished products have the disadvantage that they are already chromium-containing, i.e. that further processing to give a chromium-free leather is not possible and the wastes from the further processing, for example shaving, have to be worked up and disposed of by an expensive procedure. Moreover, the water content cannot be reduced below about 40 to 80% by weight since, on drying to lower water contents, the appearance of the skin is irreversibly changed: creases are fixed and subsequent dyeing attempts lead to a nonlevel appearance, i.e. the quality is irreversibly reduced by attempts to dry to lower water contents. Resoftening without a reduction in quality is not possible.

In contrast, wet white semifinished products have the advantage that they are not contaminated with the heavy metal chromium, but they are very susceptible to attacks by microorganisms, in particular by molds, and are therefore considered to be virtually untransportable.

In addition, wet white semifinished products practically cannot be dried to a water content below about 40 to 80% by weight since they dry to a horny material with fiber adhesion, and resoftening is thus impossible.

Known semifinished leather products have to be biologically stabilized with addition of biocides. However, the use of biocides, which have been necessary to date for stabilizing semifinished leather products, is, apart from their price, not unproblematic since some biocides may also be toxic, sensitizing or allergenic to humans and/or eliminate toxicologically harmful substances, in particular formaldehyde.

The main problem associated with known semifinished leather products is therefore that the water content must not fall below a certain level if the quality of the leather to be produced in the subsequent process steps is not to be adversely affected. On the other hand, however, this still relatively high water content leads to correspondingly high transport costs and in particular to limited transportability and storability since such semifinished leather products are ideal culture media for microorganisms.

There has therefore been no lack of attempts to provide processes for the production of semifinished products, which processes meet these contradictory requirements, i.e. reduce the water content to a range in which there is no longer any threat of attack by microorganisms and at the same time the quality of semifinished leather products is not adversely affected.

EP-B 0 281 486 describes a process for the biological stabilization of pickled pelts, in which a residual water content of only about 20% by weight can be achieved by replacing water by a substance selected from the group consisting of the polyalcohols, the condensates of fatty alcohols with ethylene oxide and the condensates of alkylphenols with ethylene oxide. However, this process has the substantial disadvantage that substances which have surface-active properties and determine the basic character of the semifinished product and adversely affect subsequent tanning steps, for example by influencing the fat distribution, are introduced for stabilizing the semifinished product. Moreover, such semifinished products have a relatively low shrinkage temperature in the region of about 50° C.

It is an object of the present invention to provide a process for the production of a biologically stable semifinished leather product, which process is environmentally friendly, does not adversely affect the quality of the semifinished product and end products produced therefrom and does not impose any restrictions at all in the further processing.

We have found that this object is achieved by a process for the production of a semifinished leather product from an animal hide by pretanning with a chromium-free tanning agent, wherein pretanning is effected with the additional use of a clay mineral which, after stirring for 30 minutes in water at 50° C. at a circumferential rotor speed of from 5 to 25 m/s, has a number average particle diameter of less than 2 μm or a bimodal size distribution with a first, finely divided fraction whose number average particle diameter is less than 0.5 μm and a second, coarser fraction whose number average particle diameter is less than 5 μm, in each case determined by the method according to ISO 13320-1, by combined laser light diffraction and light scattering, the proportion of the first, finely divided fraction being from 10 to 90% by weight, and wherein the pretanned animal hide is dried to a water content of from 5 to 45%, based on the total weight of the semifinished leather product.

It has surprisingly been found that semifinished leather products dry with a loose structure and isolated fibers as a result of pretanning with the use of finely divided clay minerals having the particle diameter as defined above and, after drying, can be readily resoftened with pure water without additives.

Clay minerals which, after stirring for 30 minutes in water at 50° C. at a circumferential rotor speed of from 5 to 25 m/s, have a number average particle diameter of less than 2 μm or a bimodal size distribution with a first, finely divided fraction whose number average particle diameter is less than 0.5 μm and a second, coarser fraction whose number average particle diameter is less than 5 μm, the proportion of the first, finely divided fraction being from 10 to 90% by weight, are disclosed as tanning agents or for the preparation of tanning agents in the non-prior-published German Patent Application DE 102 37 259.

Clay minerals having the particle sizes defined above form stable formulations for use in chromium-free or chrome tanning which ensure improved properties of the leather obtained thereby.

A treatment with a sufficient amount, as a rule about 950 ml, of water, based on 50 g of the clay mineral at 50° C. and with vigorous stirring, at a circumferential rotor speed of from 5 to 25, preferably from 10 to 20, m/s, for 30 minutes is required for the delamination for determining the number average particle diameter, the clay mineral being dispersed in water. For example, a rotor-stator Ultraturrax® mixer from IKA can be used for this purpose. By means of this treatment, it is intended to ensure that the clay mineral is delaminated until the particle size no longer changes.

The determination of the particle sizes and particle size distribution was effected according to ISO 13320-1 by combined laser light diffraction and light scattering using a Malvern 2000 analysis instrument from Malvern.

It is assumed that, for the action of the clay minerals having the particle sizes defined above, the interaction thereof with the collagen chains of the hide is essential. This interaction is possible, for example, via hydrogen bridges between collagen and the surface hydroxyl groups of the clay minerals. It has surprisingly been found that clay minerals having the defined particle sizes are irreversibly incorporated into the hide.

Clay minerals are weathering products of primary aluminosilicates, i.e. of compounds having different proportions of aluminum oxide and silicon dioxide. Silicon is surrounded tetrahedrally by four oxygen atoms, while aluminum is present in octahedral coordination. Clay minerals predominantly belong to the phyllosilicates, also referred to as sheet silicates or leaf silicates, but in some cases also to the band silicates (cf. Römpp Chemie Lexikon, 9th edition, 1995, pages 4651 and 4652).

For the novel formulations, it is particularly advantageous if the clay mineral is a phyllosilicate. Preferably, the phyllosilicate may be a kaolinite, muscovite, montmorillonite, smectite, saponite, vermiculite, hallosite or bentonite, in particular a hectorite or an organically modified variant thereof.

Particularly good results are obtained if substances which, owing to their chemical structure, are capable of forming strong hydrogen bonds with the clay mineral, in particular urea or urea derivatives, alcohols, polyols, propylene carbonate, organic amides, urethanes, saccharides or derivatives of saccharides, in particular nitrocellulose, sulfite cellulose or ethylhexylcellulose, are added to the clay minerals before or during the use thereof as tanning agents. Inter alia, the delamination of the clay mineral, in particular of the sheet silicate, is supported by this treatment.

In addition to the clay mineral, a chromium-free tanning agent, preferably an aldehyde tanning agent, an isocyanate, an aluminum salt, an oxazolidine or tetrakishydroxymethylphosphonium chloride, is used for the pretanning.

Preferably used clay minerals are those which have a number average particle diameter of less than 1 μm.

After the novel process, the animal hides pretanned using a finely divided clay mineral are dried to a water content of from 5 to 45, preferably from 15 to 35, % by weight, based on the total weight of the semifinished leather product.

By bringing the water content to below 45, preferably below 35, % by weight, the pretanning animal hide is brought to a state which is biologically substantially stable and can nevertheless be readily resoftened without comparing the quality of the end product produced therefrom.

The drying step is in principle not limited with regard to the processing conditions: it is possible to effect drying at ambient temperature and pressure, under reduced pressure and/or at elevated temperatures, preferably by drying on a tenter frame. By means of drying on a tenter frame, substantially flat and hence easily stackable semifinished products are obtained.

The novel process preferably comprises the further processing step where the dried semifinished leather product is resoftened by treatment with water or an aqueous solution of a tanning assistant, in particular an amphoteric or cationic polymer, preferably by spraying, to a water content of from 50 to 80% by weight, based on the total weight of the semifinished leather product.

A further advantage of the novel process is due to the absorptivity of the substantially dried semifinished leather product: thus, aqueous solutions of tanning assistants having poor affinity to the hide are physically absorbed and uniformly transported and distributed in the inner hide regions, which has to date lead to unsatisfactory results owing to the comparatively low chemical potential when working in an aqueous liquor. The semifinished leather product produced by the novel process can therefore be moistened in a further processing step with an aqueous solution of a tanning assistant which is absorbed by means of physical forces, in particular osmosis, into the semifinished leather product, preferably generally aqueous solutions of proteins, in particular protein hydrolysis products, or polymers. This can advantageously be effected simultaneously with the step of resoftening by spraying or immersion.

According to the invention, a semifinished leather product which is completely open with respect to further processing to end product is thus provided. Up to the stage of the semifinished leather product, it is possible to operate in the absence of chromium, the further processing being possible either in the absence of chromium or by chrome tanning. The semifinished leather product can be shaved either prior to drying or after resoftening, chromium-free shaving always being obtained. The shaving waste, which can amount to up to 30% of the material fed to the shaving stage, is unproblematic because it is free of chromium and therefore need not be disposed of as special waste but can on the contrary be utilized as fertilizer.

A further advantage is that hide defects or quality-impairing abnormalities of the hide are more readily observable on the dried semifinished products in terms of defect detection and hence the sorting with respect to hide quality can be carried out more easily, more quickly and with improved reproducibility. A further advantage is the reduced water content, which leads to obvious economic advantages with regard to transport and storage.

The examples which follow illustrate the invention.

COMPARATIVE EXAMPLE C0 AND EXAMPLES E1 TO E5

The commercial grades shown below under their trade name are products from BASF AG, Ludwigshafen.

COMPARATIVE EXAMPLE C0

Butts of pickled cattle sides, split to a thickness of 3 mm were treated at a pH of 2.8 to 3.0 at room temperature in succession with 3% of Relugan® GT 24, a glutaraldehyde solution, for 60 minutes and then with 3% of a 50% strength liquid sulfone tanning agent. After a drumming time of 90 minutes, the basicity was increased to pH 3.8 to 4.0 with a 2:1 mixture of Tamol® NA and sodium formate.

EXAMPLES E1 TO E5

In contrast to the pretanning described under C0, in each case 2% by weight, based on the pickle weight, of the clay minerals mentioned below were added to the liquors together with the glutaraldehyde solution or immediately after the metering.

The morphological characteristics are shown in table 1 below. The mean particle size of the clay mineral was determined by laser diffraction/light scattering on freshly prepared suspensions each having a solids content of 5%, according to ISO 13320-1.

Liquor exhaustion and shavability were assessed visually according to a rating scale of from 1 to 5. The shrinkage temperature was determined according to DIN 53336, which was modified in the following points, as mentioned below:

point 4.1: the samples had the dimensions 3 cm·1 cm, and the thickness was not determined;

point 4.2: only one instead of 2 samples was tested per leather sample;

point 6: omitted;

point 7: the drying in the desiccator under reduced pressure was omitted and point 8: the shrinkage temperature was read when the pointer moved back.

TABLE 1

| | Silicate/ Type | Mean particle size [μm] | Liquor exhaustion [Rating 1-5] | Shava-bility [Rating 1-5] | Shrinkage temper-ature [° C.] |
|---|---|---|---|---|---|
| Comparative example C0 | — | — | 3 | 3 | 76 |
| Example E1 | Kaolin | 2.3 | 3.5 | 3 | 77 |
| Example E2 | Mont-morillonite | 1.3 | 2 | 2.5 | 78 |
| Example E3 | Bentonite | 1.1 | 2 | 2.0 | 81 |
| Example E4 | Muscovite | 1.8 | 2.5 | 1.5 | 79 |
| Example E5 | Mont-morillonite | 0.6 | 1.5 | 1 | 82 |

The table shows predominantly improved values in the liquor exhaustion, shavability and shrinkage temperature for examples E1 to E5, relative to comparative example C0.

The semifinished products obtained according to C0 and E1 to E5 were dried and then retanned. For this purpose, the hides obtained according to comparative example C0 and examples E1 to E5 were drummed, shaved to 1.5 to 1.7 mm and each cut into four strips of equal size, each weighing about 1 kg.

In the comparative experiments below denoted by the letter a, one strip each was left in the moist state, i.e. placed on a rack overnight and then further processed with the other strips of the corresponding experimental series.

In the experiments denoted by the letter b, one strip each was dried in the air at 25° C.; in the experiments denoted by the letter c, one strip each was fixed or clamped on a frame by means of clamps and dried at 45° C. in an air stream. Finally, in the examples denoted by the letter d, one strip each was dried in a dryer for 10 minutes at 45° C. and under a reduced pressure of 80 mbar. The residual water was determined using an Aqua-Boy® LMIII moisture meter from Schröder Prüfmaschinen KG, Weinheim.

For assessing the quality of the dried semifinished products, the latter were subjected to retanning to give furniture leather.

The pretanned and dried hide strips were drummed for 3 minutes together with 300%, based on the dry weight, of water. The resoftening behavior was rated using a scale from 1 to 5, a good rating indicating that a supple, absorptive hide was obtained without further mechanical treatment. Rating 5 shows irreversible hornification of the tissue.

The appearance of the fibers on the flesh side was rated using a scale from 1 to 5. Here too, rating 5 represents inhomogeneous fiber morphology with a high proportion of fiber adhesions.

For the retanning, 20% of Relugan® SI were metered and drumming effected at 30° C. for 10 minutes, followed by 20% of Densodrin® PS, which was allowed to act for a further 90 minutes. Furthermore, 8% of Basyntan® SW and 4% of Luganil® Brown NGB were used. This was followed by acidification to pH 3.6 with 3% of formic acid for 30 minutes. About 50% less chemicals in the form of tanning assistants were added to the test strips of the a series.

The leathers were washed twice with 500% of water, sammed, dried in the air and staked. The evaluation of the leather with respect to the quality properties of body, levelness and grain tightness was effected using a rating scale from 1 to 5. The tensile strength was determined according to DIN 53328.

TABLE 2

| | Water con-tent [%] | Fiber appear-ance (flesh side dry) | Resoft-ening [Rating 1-5] | Body [Rating 1-5] | Level-ness [Rating 1-5] | Tensile strength [N] | Grain tight-ness [Rating 1-5] |
|---|---|---|---|---|---|---|---|
| C0a | 56 | — | — | 3.5 | 3 | 226 | 3.5 |
| C0b | 27 | 5 | 5 | — | — | — | — |
| C0c | 25 | 5 | 5 | — | — | — | — |
| C0d | 28 | 5 | 5 | — | — | — | — |
| C1a | 54 | — | — | 3 | 2 | 240 | 3 |
| E1b | 24 | 2.5 | 2 | 2.5 | 2 | 232 | 2.5 |
| E1c | 25 | 2 | 3 | 2.5 | 1.5 | 230 | 2 |
| E1d | 21 | 2.5 | 3.5 | 3 | 2 | 239 | 3 |
| C2a | 58 | — | — | 2.5 | 2.5 | 256 | 2 |
| E2b | 23 | 2 | 2 | 1.5 | 2 | 251 | 2 |
| E2c | 23 | 2 | 1.5 | 1.5 | 1.5 | 230 | 2 |
| E2d | 22 | 3 | 2 | 2 | 2.5 | 248 | 2.5 |
| C3a | 60 | — | — | 2 | 2 | 243 | 2.5 |
| E3b | 25 | 2 | 2 | 2 | 2 | 234 | 2 |
| E3c | 24 | 1.5 | 2 | 1.5 | 1.5 | 228 | 2 |
| E3d | 21 | 2.5 | 2.5 | 2 | 2 | 230 | 3 |
| C4a | 57 | — | — | 1.5 | 2 | 274 | 1.5 |
| E4b | 26 | 1 | 2 | 1.5 | 1.5 | 265 | 2 |
| E4c | 23 | 1 | 1 | 2 | 1 | 260 | 1 |
| E4d | 23 | 2 | 1.5 | 2 | 1.5 | 268 | 1.5 |
| C5a | 56 | — | — | 1 | 2 | 269 | 2.5 |
| E5b | 22 | 1.5 | 1 | 1.5 | 1.5 | 274 | 2 |
| E5c | 24 | 2 | 1 | 1 | 1 | 267 | 1.5 |
| E5d | 21 | 2.5 | 1.5 | 2 | 1 | 276 | 1.5 |

The results in table 2 show that, in comparative experiments C0b to C0d, the drying led to an extreme quality deterioration in the fiber appearance on the flesh side and to fiber adhesion during resoftening. No leather end products could be obtained from the dried experimental strips of series C0.

A comparison of the a series (without drying) with the dried experimental strips of series b to d predominantly showed an improvement in the quality features of body, levelness, grain tightness and tensile strength of the retanning end products.

EXAMPLES 6 TO 9

Retanning with Chromium-Containing Tanning Agents to Give Shoe Leather

Four pickled cattle sides having a split thickness of 3.0 mm were converted into the corresponding semifinished product by the wet white standard process described above under comparative example C0.

The tanning liquor contains no clay mineral in comparative example C6, whereas in each case 2.5% of montmorillonite powder, corresponding to example E5, were used in examples 7 to 9.

The pretanned hides were shaved to 1.6 to 1.8 mm after samming. The hides from examples E8 and E9 were dried overnight on a tenter frame at 45° C. and the hides from comparative example C6 and example E7 were, on the other hand, protected from drying out until further processing.

The resoftening was effected in example E8 by immersion in water (150%) in an appropriate trough. In example E9, the hide was soaked by spraying with a 20% strength solution of protein hydrolysis product obtained from leather wastes and was then placed on a rack for 2 hours.

The further processing of the hides was then effected in a separate drum in each case, together with 150%, based on the shaved weight, of water, about 0.3% of formic acid, to a pH of from 3.2 to 3.5, and 5% of Chromitan® B, the leathers being drummed at 30° C. for 90 minutes. Thereafter, the basicity was raised to pH 3.9 to 4.1 with sodium bicarbonate, 1% of the dye Luganil® Brown was metered in after the liquor had been changed (100%) at from 25 to 35° C. and drumming was effected for 10 minutes.

Thereafter, 3% of the polymer tanning agent Relugan® RV, 5% of the sulfone tanning agent Basyntan® DLX and 2% of the resin tanning agent Relugan® DLF were added and drumming was carried out again for 20 minutes at 10 revolutions per minute. Furthermore, the hide was treated for 40 minutes with 3% of the vegetable tanning agent Mimosa®, followed by treatment with a further 2% of the dye Mimosa® for 40 minutes.

The mixture was acidified to pH 3.6 to 3.8 with formic acid. After 20 minutes, the liquor was discharged and washing was effected with 200% of water. Finally, 5% of Lipodermlicker® CMG and 2% of Lipodermlicker® PN were metered in 100% of water at 50° C. After a drumming time of 45 minutes, acidification was effected with 1% of formic acid.

The washed leathers were sammed, dried and staked and assessed according to the quality features shown in table 3 below.

The chromium exhaustion (in %) is based on the respective available amount of chromium. The chromium concentration of the liquor was determined titrimetrically. The liquor exhaustion is based on substances which are used in the further retanning steps, in particular resin tanning agents, fatliquoring agents or dyes, in each case samples being taken after the dyeing and fatliquoring and being visually assessed.

TABLE 3

| | Cr exhaustion [%] | Liquor exhaustion | Body | Grain tightness | Softness | Tensile strength* [N] | Stitch tear resistance** [N] | Levelness | Grain appearance |
|---|---|---|---|---|---|---|---|---|---|
| C6 | 82 | 3 | 3 | 2.5 | 2.5 | 298 | 231 | 3 | 3 |
| E7 | 89 | 2 | 1.5 | 1.5 | 2 | 323 | 248 | 2.5 | 2 |
| E8 | 91 | 1.5 | 2 | 2 | 1 | 309 | 256 | 1.5 | 2 |
| E9 | 93 | 1.5 | 1.5 | 2 | 1.5 | 318 | 253 | 1.5 | 1.5 |

The table shows that, in examples E7 to E9, all leather properties are improved compared with comparative example C6 and moreover the liquor exhaustion is likewise improved.

We claim:

1. A process for the production of a semifinished leather product from an animal hide, the process comprising:

pretanning an animal hide with a chromium-free tanning agent to produce a pretanned animal hide, wherein pretanning is effected with the additional use of a clay mineral which, after stirring for 30 minutes in water at 50° C. at a circumferential rotor speed of from 5 to 25 m/s, has a bimodal size distribution with a first, finely divided fraction whose number average particle diameter is less than 0.5 μm and a second, coarser fraction whose number average particle diameter is less than 5 μm, in each case determined by the method according to ISO 13320-1, by combined laser light diffraction and light scattering, the proportion of the first, finely divided fraction being from 10 to 90% by weight, and the pretanned animal hide is dried to a water content of from 5 to 45%, based on the total weight of the semifinished leather product.

2. The process as claimed in claim 1, wherein the chromium-free tanning agent for the pretanning is selected from the group consisting of an aldehyde tanning agent, an isocyanate, an aluminum salt, an oxazolidine and tetrakishydroxymethylphosphonium chloride.

3. The process as claimed in claim 1, wherein the pretanned animal hide is dried to a water content of from 15 to 35%, based on the total weight of the semifinished leather product.

4. The process as claimed in claim 1, wherein substances which, owing to their chemical structure, form strong hydrogen bonds with the clay mineral, are added to the clay mineral before or during the use thereof in the pretanning.

5. The process as claimed in claim 1, wherein the clay mineral is a phyllosilicate.

6. The process as claimed in claim 5, wherein the phyllosilicate is selected from the group consisting of a kaolinite, a muscovite, a montmorillonite, a smectite, a saponite, a vermiculite, a hallosite, a bentonite and organically modified variants of these phyllocilicates.

7. The process as claimed in claim 1, wherein the drying is carried out under conditions selected from the group consisting of at ambient temperature and ambient pressure, under reduced pressure, at elevated temperatures, and at reduced pressure at elevated temperatures.

8. The process as claimed in claim 1, further comprising: moistening the semifinished leather product with an aqueous solution of a tanning assistant which is absorbed into the semifinished leather product by means of a physical force.

9. The process as claimed in claim 1, further comprising: resoftening the dried semifinished leather product by treatment with water or with an aqueous solution or suspension of a tanning assistant, to a water content of from 50 to 80%, based on the total weight of the semifinished leather product.

10. The process as claimed in claim 2, wherein the chromium-free tanning agent, which is an aldehyde tanning agent, is glutaraldehyde.

11. The process as claimed in claim 4, wherein the substances are selected from the group consisting of urea, an alcohol, a polyol, a propylene carbonate, an organic amide, a urethane and a saccharide.

12. The process as claimed in claim 11, comprising the saccharide, wherein the saccharide is selected from the group consisting of nitrocellulose, sulfide cellulose and ethylcellulose.

13. The process as claimed in claim 6, wherein the bentonite is a hectorite.

14. The process as claimed in claim 8, wherein the drying is carried out on a tenter frame.

15. The process as claimed in claim 8, wherein the physical force comprises osmosis.

16. The process as claimed in claim 8, wherein the semifinished leather product is moistened with an aqueous solution of a protein hydrolysis product.

17. The process as claimed in claim 9, wherein the tanning assistant is an amphoteric or cationic polymer.

18. The process as claimed in claim 9, wherein the resoftening comprises spraying the dried semifinished leather product with the treatment.

19. The process of claim 17, wherein the tanning assistant is a cationic polymer.

20. The process of claim 17, wherein the tanning assistant is an amphoteric polymer.

* * * * *